US007544094B1

(12) United States Patent
Paglia et al.

(10) Patent No.: US 7,544,094 B1
(45) Date of Patent: Jun. 9, 2009

(54) CONNECTOR ASSEMBLY WITH GRIPPING SLEEVE

(75) Inventors: Richard Paglia, Springfield, MA (US); Weixing Chen, Changzhou (CN); Minghua Gu, Changzhou (CN)

(73) Assignee: Amphenol Corporation, Wallingford, CT (US)

( * ) Notice: Subject to any disclaimer, the term of this patent is extended or adjusted under 35 U.S.C. 154(b) by 0 days.

(21) Appl. No.: 12/003,109

(22) Filed: Dec. 20, 2007

(51) Int. Cl.
*H01R 9/05* (2006.01)

(52) U.S. Cl. ..... 439/585

(58) Field of Classification Search ..... 439/585, 439/584, 578
See application file for complete search history.

(56) References Cited

U.S. PATENT DOCUMENTS 3,323,098 A * 5/1967 O'Keefe et al. ..... 439/585
4,116,521 A * 9/1978 Herrmann, Jr. ..... 439/274
4,408,821 A * 10/1983 Forney, Jr. ..... 439/387
4,452,503 A * 6/1984 Forney, Jr. ..... 439/585
4,660,921 A 4/1987 Hauver
4,690,481 A * 9/1987 Randolph ..... 439/585
4,854,893 A 8/1989 Morris
5,002,503 A * 3/1991 Campbell et al. ..... 439/578
5,007,861 A * 4/1991 Stirling ..... 439/578
5,073,129 A * 12/1991 Szegda ..... 439/585
5,141,451 A * 8/1992 Down ..... 439/585
5,217,393 A * 6/1993 Del Negro et al. ..... 439/585
5,295,864 A * 3/1994 Birch et al. ..... 439/578
5,352,134 A * 10/1994 Jacobsen et al. ..... 439/584
5,435,745 A * 7/1995 Booth ..... 439/584
5,456,614 A * 10/1995 Szegda ..... 439/321
5,466,173 A * 11/1995 Down ..... 439/584
5,474,470 A * 12/1995 Hammond, Jr. ..... 439/578
5,499,934 A * 3/1996 Jacobsen et al. ..... 439/585
5,548,088 A * 8/1996 Gray et al. ..... 174/74 R
5,598,132 A 1/1997 Stabile
5,651,699 A * 7/1997 Holliday ..... 439/585
5,660,565 A * 8/1997 Williams ..... 439/585
6,027,373 A * 2/2000 Gray et al. ..... 439/578
6,034,325 A 3/2000 Nattel et al.
6,331,123 B1 * 12/2001 Rodrigues ..... 439/584
D462,327 S 9/2002 Montena
6,454,462 B2 * 9/2002 Nguyen et al. ..... 385/53
6,767,247 B2 7/2004 Rodrigues et al.
6,808,415 B1 * 10/2004 Montena ..... 439/584
6,884,115 B2 * 4/2005 Malloy ..... 439/584
6,971,912 B2 * 12/2005 Montena et al. ..... 439/578
7,014,501 B2 * 3/2006 Montena ..... 439/578
7,029,304 B2 * 4/2006 Montena ..... 439/320
7,059,900 B2 * 6/2006 Holliday ..... 439/578
7,097,500 B2 8/2006 Montena
7,128,603 B2 * 10/2006 Burris et al. ..... 439/578
7,163,420 B2 * 1/2007 Montena ..... 439/578
7,226,300 B2 6/2007 Khemakhem
7,311,555 B1 12/2007 Burris et al.
7,329,149 B2 * 2/2008 Montena ..... 439/584
7,364,462 B2 * 4/2008 Holland ..... 439/584
2002/0013088 A1 * 1/2002 Rodrigues et al. ..... 439/578

* cited by examiner

*Primary Examiner*—T C Patel
*Assistant Examiner*—Vladimir Imas
(74) *Attorney, Agent, or Firm*—Blank Rome LLP

(57) ABSTRACT

A connector assembly includes an electrical connector and a sleeve. The electrical connector has opposite first and second ends. The first end is rotatable with respect to the second end and configured to couple to a mating connector. The second end is configured to terminate a cable. The sleeve has an outer gripping surface, and an inner bore for receiving the electrical connector such that the sleeve and the first end of the connector are rotatable together.

22 Claims, 7 Drawing Sheets

CONNECTOR ASSEMBLY WITH GRIPPING SLEEVE

CROSS-REFERENCE TO RELATED APPLICATION

This application may relate to commonly assigned, co-pending U.S. patent application Ser. No. 12/003,108, entitled "Connector Assembly with Gripping Sleeve", filed concurrently herewith, the subject matter of which is herein incorporated by reference.

FIELD OF THE INVENTION

The present invention relates to connector assemblies with a sleeve. In particular, the present invention relates to electrical connector assemblies with a sleeve to facilitate gripping and mating of a connector to its counterpart connector.

BACKGROUND OF THE INVENTION

Connector assemblies are often used to terminate a cable and adapt the cable for attachment to a device, another connector, or another cable. The connector assembly often includes a body with a rotating nut portion with internal threads. The nut portion rotates with respect to the body so that the internal threads of the nut can engage corresponding threads of the device, the other connector, or the other cable. For proper functioning of the connector assembly, the nut portion must be fully twisted onto the corresponding threads. A loose connection can fail to provide the positive contact needed for continuity between the cable and the device, the other connector, or the other cable. Also, a loose connection can come apart accidentally disrupting the connection to the device, the other connector, or the other cable. A loose connection can also cause signal leakage and degraded performance.

Furthermore, connector assemblies are often assembled under conditions in which the user cannot adequately grasp the nut portion of the connector assembly. Without a sure grip, the user often fails to properly mate the connector assembly with the other device, the other connector, or the other cable. Also, the likelihood of a loose connection occurring increases, making the connector assembly more susceptible to separating from the device, the other connector, or the other cable and may cause signal leakage.

Thus, a need in the art exists for an improved connector assembly that assists in gripping the connector of the connector assembly and mating the connector to its counterpart connector.

SUMMARY OF THE INVENTION

Accordingly, it is an aspect of the invention to provide a connector assembly with a connector and a sleeve to facilitate gripping and mating of the connector to its counterpart connector.

One embodiment of the present a connector assembly comprising of an electrical connector having opposite first and second ends. The first end is rotatable with respect to the second end and configured to couple to a mating connector and the second end being configured to terminate a cable. A sleeve having an outer gripping surface and an inner bore receives the first and second ends of the electrical connector. The sleeve and the first end of the connector being rotatable together with respect to the second end of the connector. The inner bore includes a retaining member configured to substantially prevent axial movement of the electrical connector with respect to the sleeve.

Another embodiment of the present invention provides a connector assembly, comprising of an electrical connector that has opposite first and second ends. The first end is rotatable with respect to the second end and configured to couple to a mating connector. The second end being configured to terminate a cable. A sleeve including an inner bore extending through the sleeve. The inner bore receives the electrical connector. One portion of the inner bore is configured to ensnare the first end of the electrical connector, and another portion of the inner bore is configured to retain the electrical connector in the inner bore. And the sleeve includes an outer gripping surface.

Yet another embodiment of the present invention provides a method of forming a connector assembly. The method comprising the steps of: providing a first end and a second end of an electrical connector, the first end and the second end adapted to be coupled to each other, the first end being rotatable with respect to the second end, the first end configured to couple to a mating connector, and the second end configured to terminate a cable; providing a sleeve configured to ensnare the first end and slide over the second end, the sleeve having an outer gripping surface, whereby the sleeve and the first end of the electrical connector together rotate with respect to the second end of the connector; inserting the first end into the sleeve; inserting the second end into the sleeve; and coupling the first end and the second end within the sleeve.

Other objects, advantages and salient features of the invention will become apparent from the following detailed description, which, taken in conjunction with the annexed drawings, discloses a preferred embodiment of the present invention.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE INVENTION

Referring to FIGS. 1-13, the present invention relates to a connector assembly 100 and a method of manufacturing a connector assembly 100 with a sleeve 120 that ensnares a portion of a connector 110 and provides improved gripping. The sleeve 120 is not easily removed from the connector 110 for safety reasons.

Figure 1:
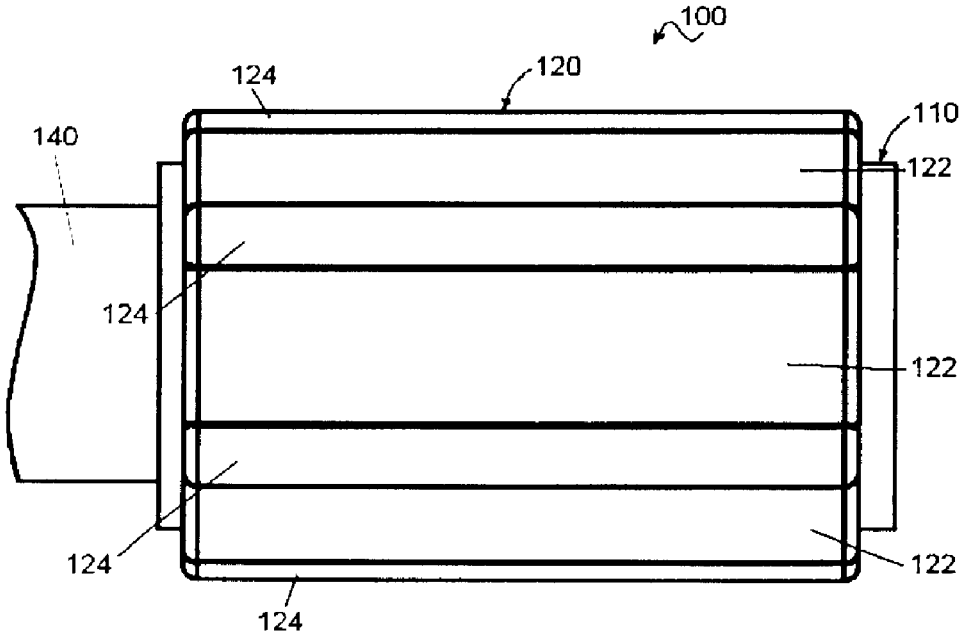
FIG. 1 is a side elevational view of a connector assembly according to an exemplary embodiment of the present invention.

Referring to FIG. 1, the connector assembly 100 includes, at least, the connector 110 and the sleeve 120. The connector 110 terminates a cable 140 and connects to a mating connector, device, or cable. The connector 110 can be an electrical connector, an optical connector, a fluid connector, a pneumatic connector, a hydraulic connector, or some other type of connector. To simplify and facilitate the description of the invention, the connector 110 will be described as an electrical connector, and in particular, an F connector used with coaxial cables. However, the invention is not limited to only embodiments with an electrical connector.

The sleeve 120 facilitates the mating of the connector 110 to its mating connector, device, or cable. The sleeve 120 ensnares a portion of the connector 110. The sleeve 120 is placed on the connector 110 to ensure that the sleeve 120 is not lost or separated from the connector 110. The sleeve 120 can be made of any rubber, synthetic rubber, neoprene, thermoplastic, thermosetting plastic, plastic (such as, but not limited to, polyethylene, polypropylene, polystyrene, acrylonitrile butadiene styrene, polyethylene terephthalate, polyester, polyamides, polyvinyl chloride, polyurethanes, or polycarbonate), combinations of the above, and other similar materials.

The sleeve 120 can be sized to allow a user to achieve high levels of torque when mating the connector 110 with another device or connector without the use of tools. Also, the sleeve 120 can have a gripping surface 122 that aids in grasping the sleeve 120, facilitates the use of tools, or both. The gripping surface 122 can include ridges, grooves, knurls, combinations of the aforementioned, and the like. The gripping surface 122 may also be smooth. The sleeve 120 can also have one or more spines 124. The spines 124 further facilitate gripping the connector assembly 100. The spines 124 preferably extend longitudinally the length of the sleeve 120.

The cable 140 provides a pathway for an electrical signal, an optical signal, a fluid, a gas, or some other type of signal or matter. For embodiments where the connector 110 is an F connector, the cable 140 is a coaxial cable. The coaxial cable can be, for example, RG-6, CATV distribution coaxial, RG-8, RG-11, RG-58, RG-59, or other similar cables.

Figure 2:
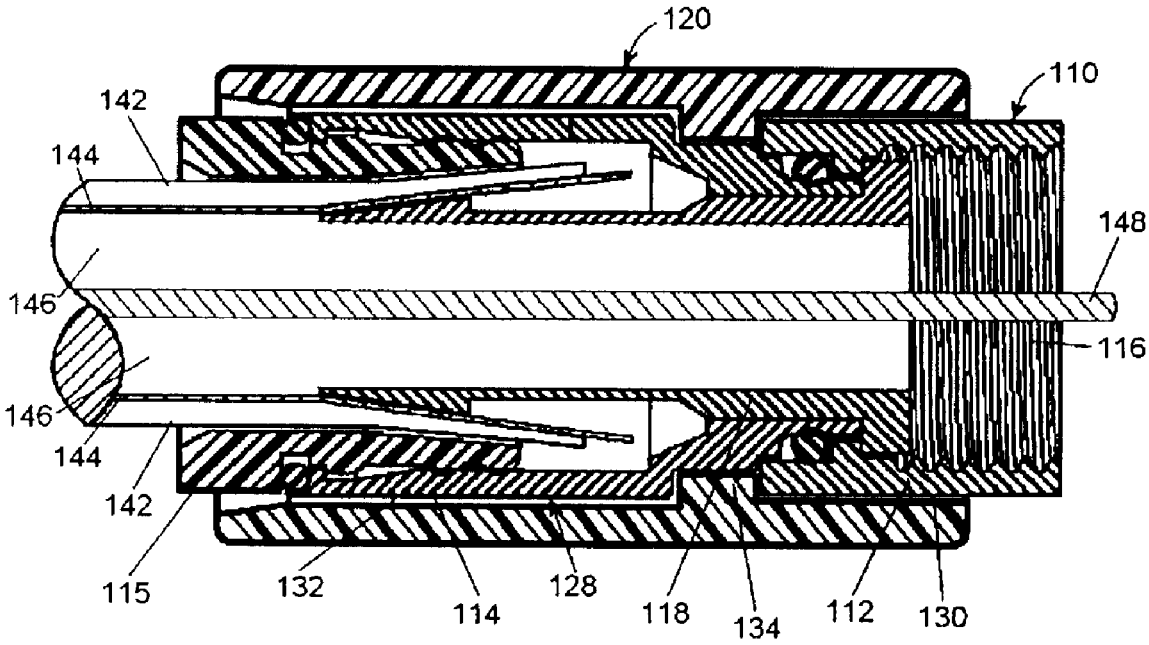
FIG. 2 is a sectional view of the connector assembly illustrated in FIG. 1.

Referring to FIG. 2, the connector 110 has a first end 112 and a second end 114 opposite the first end 112. The first end 112 includes a mating structure 116 that couples the connector 110 to a mating connector, device, or cable. The mating structure 116 is preferably threads as shown, but can be any structure configured to mate one device or connector with another, such as a radially extending post adapted to be received in a slot of the mating connector or the slot that receives the post. The first end 112 requires some manipulation, such as twisting, pushing, or pulling, to mate the connector 110 with a mating connector, device, or cable. The manipulation can be completed manually or with a tool. When twisting the connector 110, the first end 112 rotates with respect to the second end 114. Alternatively, if the connector 110 requires pushing or pulling, the first end 112 moves longitudinally with respect to the second end 114. The second end 114 of the connector 110 terminates the cable 140. The second end 114 can terminate the cable 140 such as by crimping, welding, using an adhesive, or other similar methods.

Whether the first end 112 rotates with respect to the second end 114 or moves longitudinally with respect to the second end 114, the sleeve 120 preferably ensnares the first end 112 of the connector 110 so that the sleeve 120 and the first end 112 rotate or move together with respect to the second end 114 of the connector 110. The second end 114 does not rotate or move when the sleeve 120 is rotated or moved because the second end 114 is fixed to the cable 140, and the sleeve 120 slides over the second end 114. Preferably, the sleeve 120 has a bore 128 that varies in cross-section along the length of the sleeve 120 to accommodate the connector 110. In the exemplary embodiment shown in FIG. 2, the bore 128 has a first portion 130 and a second portion 132. Also, the connector 110 is a conventional F connector that has a nut assembly as the first end 112 and a cylindrical second end 114. The F connector has internal threads as its mating structure 116 that engage corresponding threads of its mating connector, device, or cable. Thus, the F connector requires twisting of the first end 112 to couple the connector 110 to its mating device or connector. Also, as shown, the first portion 130 of the bore 128 ensnares the first end 112 of the connector 110 because the first portion 130 has a hexagonal shape in cross-section that corresponds to the shape of the nut assembly. The second portion 132 of the bore 128 has a circular shape in cross-section that slides over the cylindrical shape of the second end 114 of the connector 110. Accordingly, when the sleeve 120 is rotated, the first end 112 of the connector 110 rotates with respect to the second end 114. Thus, the user can grasp and twist the sleeve 120 to rotate the first end 112 which aids the engagement of the threads to a counterpart connector.

Although the connector 110 is depicted and described as an F connector to simplify and facilitate the description of the connector assembly 100, the connector 110 can also be a Bayonet Neill-Concelman ("BNC") connector, a Threaded Neill-Concelman ("TNC") connector, a C connector, an N connector, an SMA connector, or other similar electrical connector.

Furthermore, in the embodiment shown in FIG. 2, the cable 140 is a coaxial cable. The coaxial cable includes a jacket 142, a conductive sheath 144, a dielectric insulator 146, and a center conductor 148. The jacket 142 provides insulation and can be made of any material with low electrical conductivity, such as polyvinylchloride. Coaxial cables may be rigid or flexible. For rigid coaxial cables, the conductive sheath 144 is solid, while flexible coaxial cables have a braided sheath 144, usually made of small-diameter copper wire or some other conductive material. In the embodiment shown, the conductive sheath 144 electrically couples to a conductor 118 disposed within the first end 112 and the second end 114 of the F connector. The dielectric insulator 146 insulates the conductive sheath 144 from the center conductor 148 and affects the impedance and attenuation characteristics of the coaxial cable. The dielectric insulator 146 may be solid, as shown, or perforated with air spaces and can be made of any material with poor electrical conductivity, such as polyethylene. As an electrical signal travels along the cable 140, the electrical signal forms an associated magnetic field that extends beyond the cable 140 through the jacket 142 of the cable 140. The magnetic field can distort the electrical signal if the cable 140 is bent near itself or if the cable 140 is routed near another conductive material. However, electrical signals traveling by way of coaxial cables are substantially shielded by the conductive sheath 144 and confined to the center conductor 148. Thus, electrical signal transmission occurs substantially between the conductive sheath 144 and the center conductor 148 through the dielectric insulator 146. Therefore, coaxial cables can be bent and moderately twisted without the electrical signal affecting itself. Also, coaxial cables can be routed relatively closer to other conductive materials without distorting the electrical signal.

The F connector depicted in FIG. 2 also includes a compression ring. The compression ring is used together with a crimping tool to terminate a coaxial cable to the F connector. After the coaxial cable has been stripped, the compression ring is slipped onto the coaxial cable. Then, the stripped end of the coaxial cable is inserted into the second end 114, and the crimping tool is applied to the connector 110 and the compression ring. The crimping tool forces the compression ring into the second end 114 to secure the coaxial cable to the second end 114 of the connector 110.

The bore 128 can also include a retaining member 134 that prevents the sleeve 120 from traveling in the longitudinal direction relative to the connector 110 and slipping off the connector 110. The retaining member 134 may be a radial flange, for example. Also, in embodiments where the first end 112 moves longitudinally with respect to the second end 114 to mate the connector 110, the retaining member 134 can ensnare the first end 112 in one direction of longitudinal movement. The retaining member 134 can be formed integrally with the sleeve 120 or formed separately and attached to the sleeve 120. The retaining member 134 can be made of any suitably rigid material.

Figure 3:
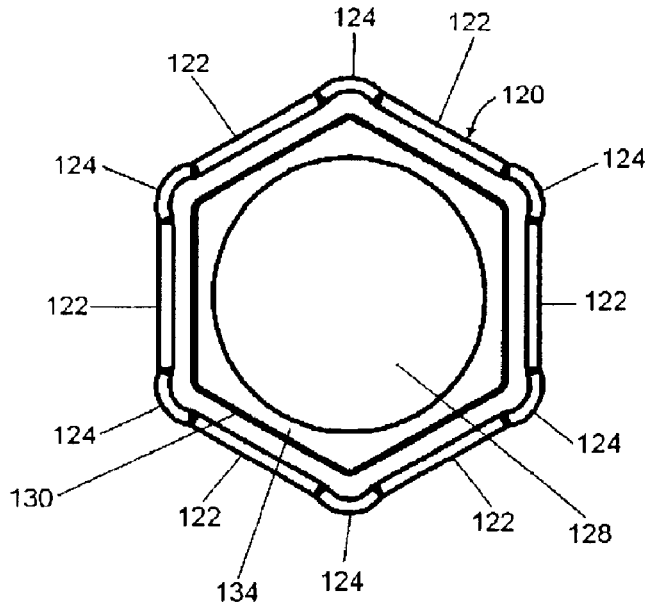
FIG. 3 is a front elevational view of a sleeve of the connector assembly illustrated in FIG. 1.
Figure 4:
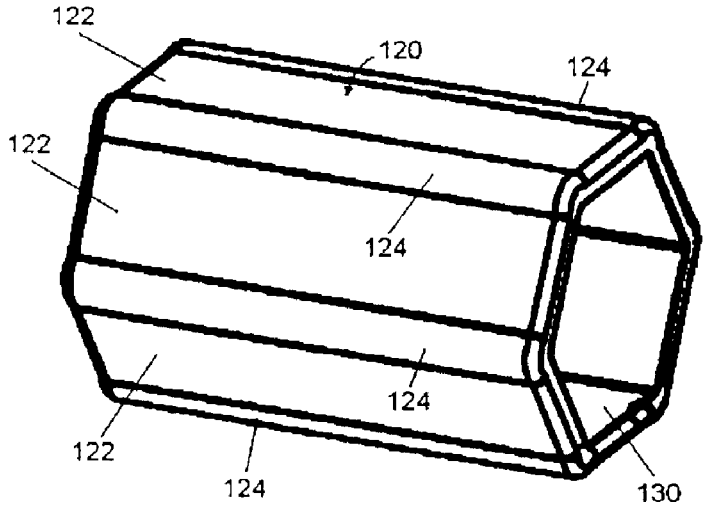
FIG. 4 is a perspective view of the sleeve illustrated in FIG. 3.

Referring to FIGS. 3 and 4, the sleeve 120 is shown without the connector 110. The sleeve 120 in the exemplary embodiment shown has a substantially hexagonal shape in cross-section. The cross-sectional shape of the sleeve 120 can be formed so that conventional tools, such as a wrench adapted to engage hexagonal nut assemblies, may be applied to the sleeve 120 to twist the connector 110. Although a substantially hexagonal shape in cross-section is depicted, the sleeve 120 can have any other shape in cross-section, such as the alternate embodiment depicted in FIGS. 5-8.

The first portion 130 of the bore 128 also has a substantially hexagonal shape. The substantially hexagonal shape of the first portion 130 conforms to the first end 112 of an embodiment where the first end 112 is a hexagonal nut assembly. By conforming to the first end 112 of the connector 110, the sleeve 120 ensnares the first end 112. Thus, by gripping and rotating the sleeve 120, the first end 112 of the connector 110 rotates. Therefore, a user may grip the gripping surface 122 of the sleeve 120 instead of the relatively smaller first end 112 when coupling the connector 110 with its mating connector, device, or cable. The sleeve design also provides mechanical support to weak points of the connector assembly 100, such as the interface between the connector 110 and the cable 140. Thus, the cable 140 is less susceptible to damage.

Referring to FIGS. 5-8, an alternate embodiment for a connector assembly 200 is shown. The connector assembly 200 includes a sleeve 220 and the connector 110. Unlike the sleeve 120, the sleeve 220 has a circular shape in cross-section and no spines. The sleeve 220 accommodates the connector 110 and extends substantially the entire length of the connector 110. Similar to sleeve 120, the sleeve 220 ensnares the first end 112 of the connector 110 but not the second end 114.

Figure 5:
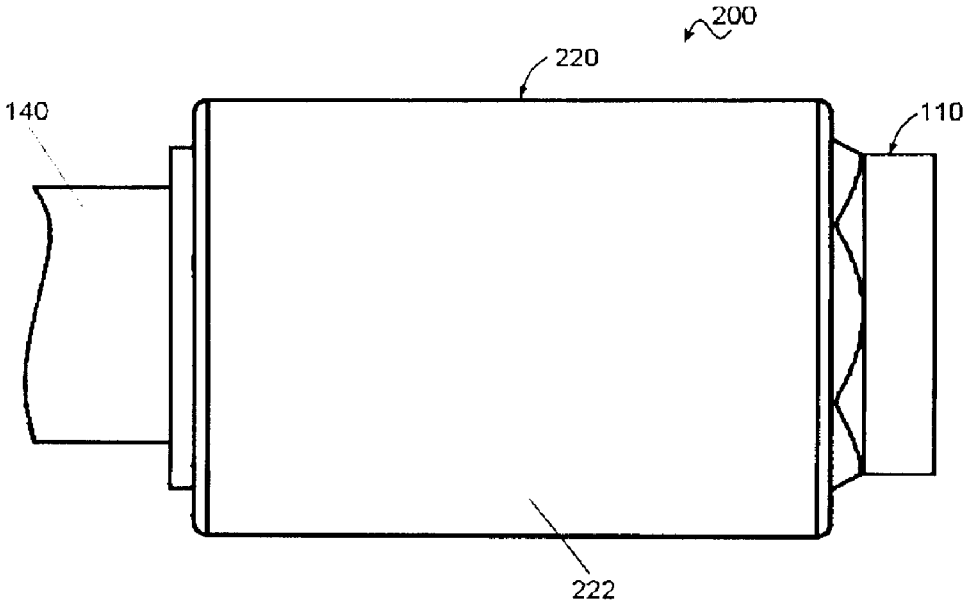
FIG. 5 is a side elevational view of a connector assembly according to an alternate embodiment of the present invention.

Referring to FIG. 5, the sleeve 220 can have either a gripping surface 222, a spine substantially similar to spine 124, or both. In the exemplary embodiment shown, the sleeve 220 has a gripping surface 222. The gripping surface 222 is substantially similar to the previously described gripping surface 122, therefore a detailed description thereof is omitted. The sleeve 220 can be made of any rubber, synthetic rubber, neoprene, thermoplastic, thermosetting plastic, plastic (such as, but not limited to, polyethylene, polypropylene, polystyrene, acrylonitrile butadiene styrene, polyethylene terephthalate, polyester, polyamides, polyvinyl chloride, polyurethanes, or polycarbonate), combinations of the above, and other similar materials.

Figure 6:
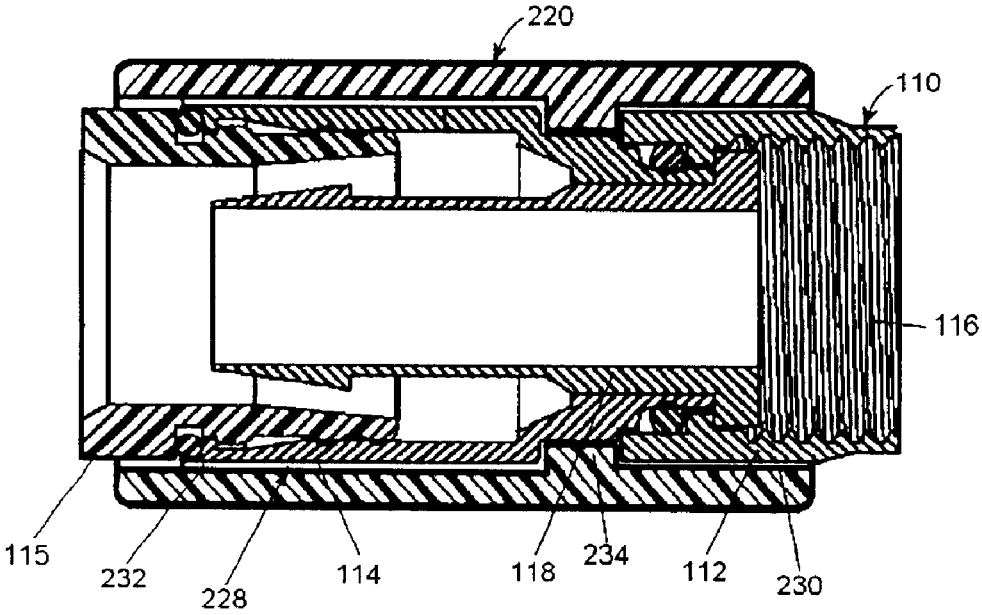
FIG. 6 is a sectional view of a sleeve and a connector of the connector assembly illustrated in FIG. 5.

Referring to FIG. 6, the sleeve 220 is configured to ensnare the first end 112 of the connector 110 but not the second end 114. The sleeve 220 has a bore 228 that varies in cross-section along the length of the sleeve 220 to accommodate the connector 110. As described above, the connector 110 can be a conventional F connector, and the F connector has a nut assembly at the first end 112 and a cylindrical second end 114.

The bore 228 of the sleeve 220 has a first portion 230 and a second portion 232. The first portion 230 of the bore 228 ensnares the first end 112 of the F connector because the first portion 230 has a substantially hexagonal shape in cross-section that corresponds to the shape of the nut assembly. The second portion 232 of the bore 228 has a substantially circular shape in cross-section that slides over the cylindrical shape of the second end 114 of the F connector. Thus, when the sleeve 220 is rotated, the first end 112 of the F connector rotates with respect to the second end 114. Therefore, the user can grasp and twist the sleeve 220 to engage the first end 112 of the F connector to its counterpart. Also, the user may obtain a better grip of the sleeve 220 because of the gripping surface 222 when coupling the connector 110 with its mating connector.

The bore 228 can also include a retaining member 234 such as a flange, that prevents the sleeve 220 from traveling in the longitudinal direction relative to the connector 110 and slipping off the connector 110. The retaining member 234 is substantially similar to the retaining member 134, and thus, a detailed description thereof is omitted.

Figure 7:
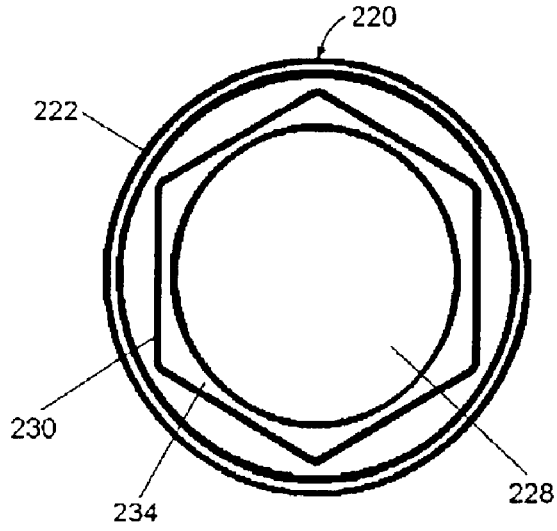
FIG. 7 is a front elevational view of the sleeve illustrated in FIG. 6.
Figure 8:
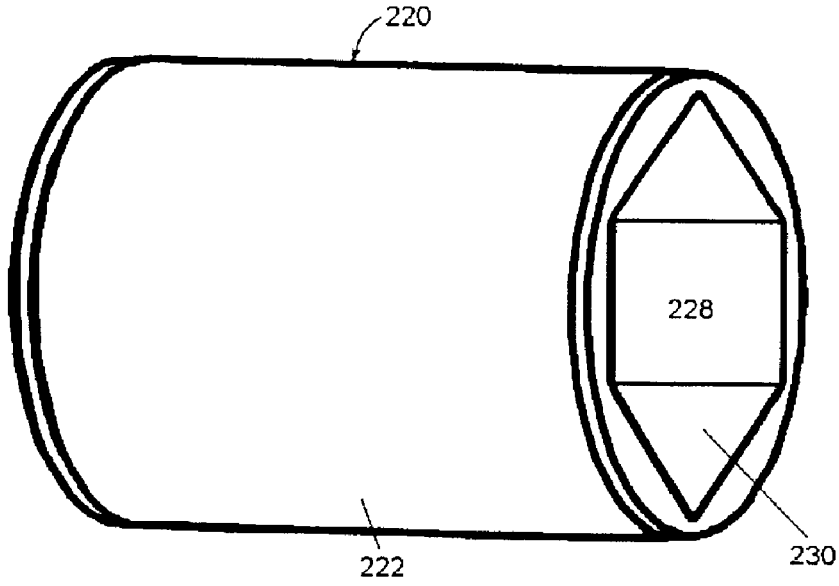
FIG. 8 is a perspective view of the sleeve illustrated in FIG. 6.

Referring to FIGS. 7 and 8, the sleeve 220 is shown without the connector 110. Unlike the substantially hexagonal shape of the sleeve 120, the sleeve 220 has a substantially circular shape in cross-section. The first portion 230 of the bore 228 ensnares the first end 112 of the connector 110. Similar to the sleeve 120, in the embodiment depicted, the first portion 230 of the bore 228 has a substantially hexagonal shape that conforms to the nut assembly of an F connector. Thus, as described above, by gripping and rotating the sleeve 120, the first end 112 of the connector 110 rotates to engage a counterpart connector. Also, the user can grip the gripping surface 222 of the sleeve 220 instead of the relatively smaller first end 112 when coupling the connector 110 to its mating counterpart. Furthermore, the sleeve 220 provides mechanical support to weak points of the connector assembly 200, for example, the interface between the connector 110 and the cable 140, so that the cable 140 is less susceptible to damage.

Figure 9:
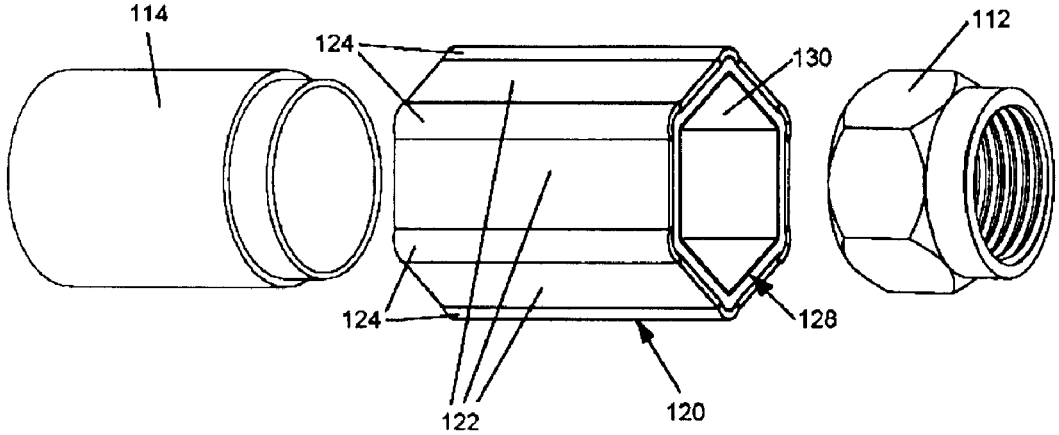
FIG. 9 is a perspective view of a first end of a connector, a second end of the connector, and the sleeve of the connector assembly illustrated in FIG. 1.

Referring to FIG. 9, to manufacture the connector assembly 100, the sleeve 120 and the components of the connector 110 are preferably formed separately. In an exemplary embodiment, the sleeve 120 is made by die casting wherein heated plastic is forced into a mold known as a die. The shape that the mold forms corresponds to the shape of the sleeve 120. After the heated plastic cools, it retains the shape of the mold. The first portion 130 of the bore 128 within the sleeve 120 is shaped to correspond to the first end 112 of the connector 110, so that the first portion 130 ensnares the first end 112. The second portion of the bore 128 is formed to receive the second end 114 of the connector 110. The sleeve 120 may also include the gripping surfaces 122 and spines 124, as shown in FIG. 9. The first end 112 and the second end 114 of the connector 110 are formed in accordance with the method of manufacturing for their particular type of connector 110.

The first end 112 is inserted into the first portion 130 of the bore 128. Preferably, the first end 112 is press-fitted into the first portion 130 to form a friction fit with the sleeve. The first end 112 may abut the retaining member 134, thereby preventing the first end from being inserted too far into the sleeve. The second end 114 is inserted into the second portion 132 of the bore 128. Preferably, the second portion 132 is sized to receive the second end 114 of the connector 110 freely. The second end may also abut the retaining member 134 preventing it from being inserted too far. Once the sleeve 110 receives the first end 112 and the second end 114 of the connector 110, the first and second ends 112 and 114 are coupled to each other within the sleeve 120. The coupling of the first and second ends 112 and 114 is completed in accordance with the particular type of connector 110 used. In the embodiment shown, the first end 112 receives a portion of the second end 114, and then the two are coupled by the conductor 118 (shown in FIG. 10).

Figure 10:
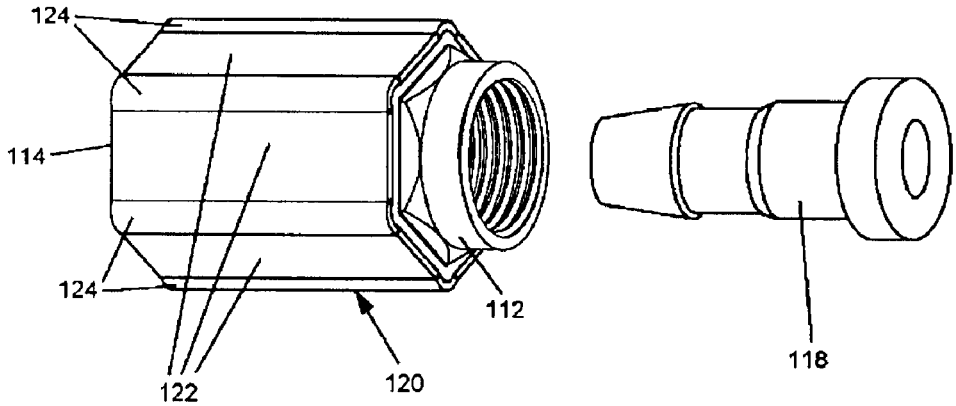
FIG. 10 is a perspective view of a conductor of the connector, the first end, the second end, and the sleeve of the connector assembly illustrated in FIG. 1.

Referring to FIG. 10, in the embodiment shown, because the connector 110 is an F connector with a conductor 118 disposed within the first and second ends 112 and 114 of the connector 110, the conductor 118 is next inserted into the connector 110. The conductor 118 is preferably inserted into the first end 112 and press-fitted into the second end 114, thereby coupling the first and second ends 112 and 114 of the connector 110 together. The conductor 118 also couples to the cable 140 which is received in the second end 114, as shown in FIG. 2.

Figure 11:
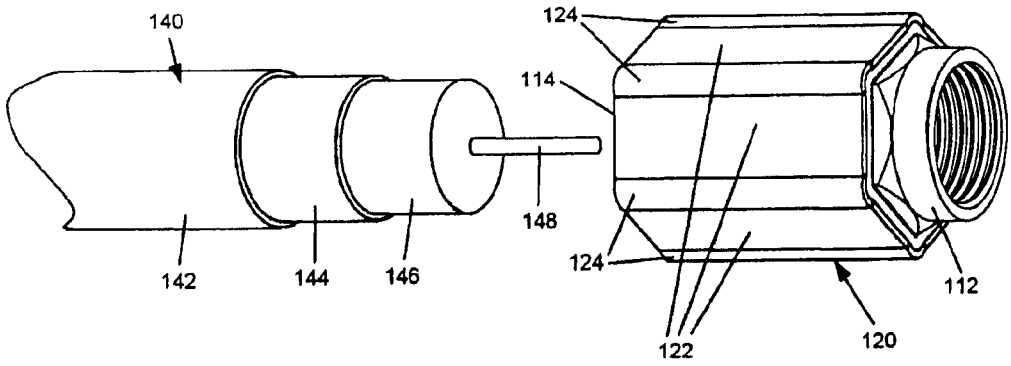
FIG. 11 is a perspective view of a cable, the connector, and the sleeve of the connector assembly illustrated in FIG. 1.

Referring to FIG. 11, the cable 140 is prepared for termination in the second end 114 of the connector 110. The cable 140 is prepared in accordance with its particular construction and method of terminating to a connector 110. For the embodiment shown, the jacket 142 of the coaxial cable 140 is stripped to expose the conductive sheath 144. Then, the conductive sheath 144 is pared or folded over to expose the dielectric insulator 146. Next, the dielectric insulator 146 is stripped to expose the center conductor 148. Then, the cable 140 is substantially prepared to be terminated in the second end 114 of the connector 110.

Figure 12:
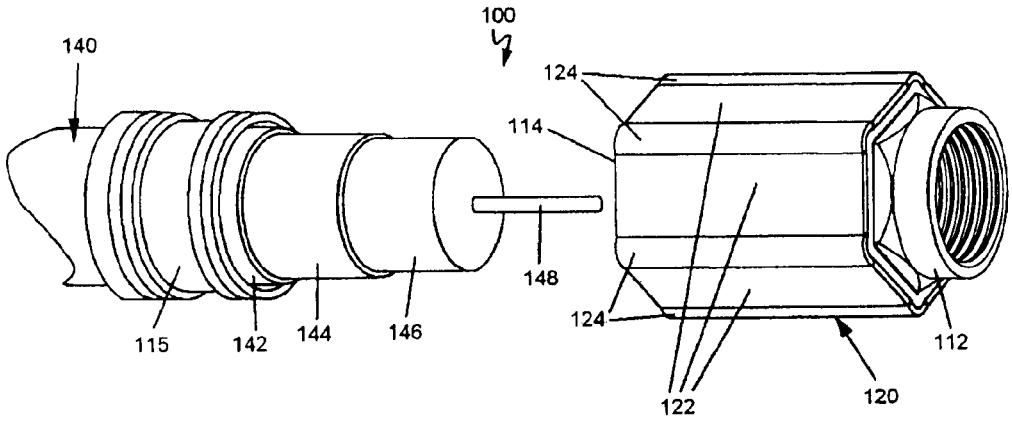
FIG. 12 is a perspective view of a compression ring, the cable, the connector, and the sleeve of the connector assembly illustrated in FIG. 1.

Referring to FIG. 12, for a coaxial cable and an F connector, after the cable 140 has been prepared for termination, the compression ring 115 is slipped onto the cable 140. In alternate embodiments, the compression ring 115 may be omitted. Then, the prepared end of the cable 140 with the compression ring 115 is preferably inserted into the second end 114 of the connector 110. Next, a crimping tool is applied to the connector 110, the sleeve 120, and the compression ring 115. Then, the crimping tool forces the compression ring 115 into the second end 114 of the connector 110, and thus the cable 140 is coupled to the second end 114. Also, as shown in FIG. 2, for an F connector and a coaxial cable, the conductive sheath 144 of the cable 140 is coupled to the conductor 118 of the connector 110.

Figure 13:
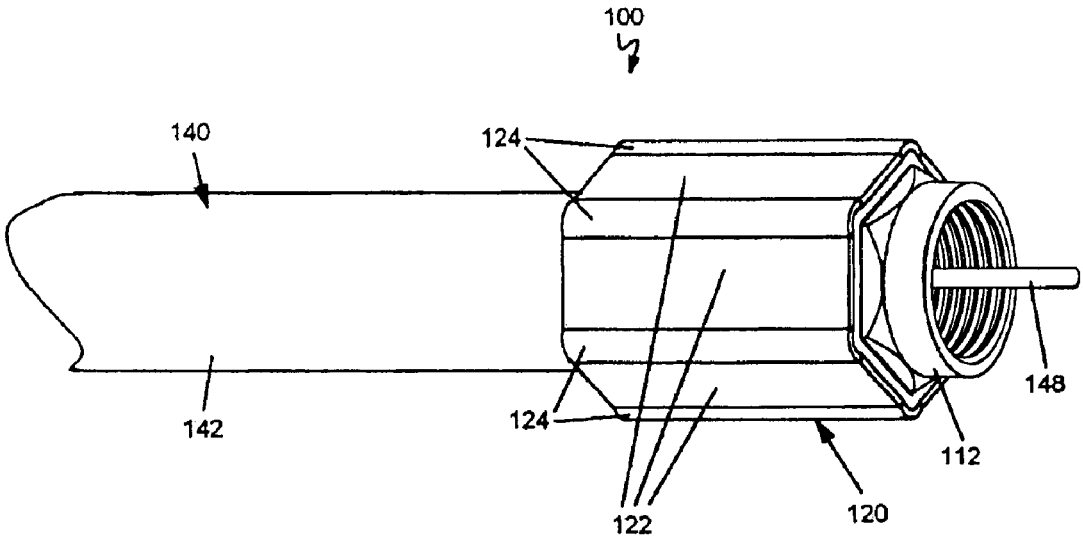
FIG. 13 is a perspective view of the connector assembly illustrated in FIG. 1.

Referring to FIG. 13, after crimping the cable 140 and the compression ring 115 to the second end 114 of the connector 110, the connector assembly 100 can be mated to its counterpart connector, another device, or another cable. As described above, the mating is facilitated by the sleeve 120, the gripping surfaces 122, the spines 124, or a combination of the aforementioned. The mating can be completed by hand or by using a tool.

As apparent from the above description, the present invention provides a connector assembly. The connector assembly includes a sleeve that provides improved gripping of a connector. Accordingly, when the connector is mated to another connector, device, or cable, the sleeve aids in the engagement of the connector to its counterpart connector, device, or cable. The sleeve provides improved gripping by having a predetermined shape in cross-section, a gripping surface, a spine, or combinations of the aforementioned. The sleeve can also provide mechanical support to weak points in the connector assembly.

While particular embodiments have been chosen to illustrate the invention, it will be understood by those skilled in the art that various changes and modifications can be made therein without departing from the scope of the invention as defined in the appended claims.

What is claimed is:

1. A connector assembly, comprising of:

an electrical connector having opposite first and second ends, said first end being rotatable with respect to said second end and configured to couple to a mating connector, said second end being configured to terminate a cable; and a sleeve having an outer gripping surface and an inner bore that receives said first and second ends of said electrical connector, said sleeve and said first end of said connector being rotatable together with respect to said second end of said connector, and said inner bore including a retaining member configured to substantially prevent axial movement of the electrical connector with respect to said sleeve;

wherein said first end is in direct contact with said second end.

2. The connector assembly according to claim 1, wherein said sleeve has a substantially hexagonal shape in cross-section.

3. The connector assembly according to claim 1, wherein said outer gripping surface has a plurality of longitudinal spines extending along said sleeve.

4. The connector assembly according to claim 1, wherein said sleeve is made of a material selected from the group consisting of rubber, synthetic rubber, neoprene, thermoplastic, thermosetting plastic, polyethylene, polypropylene, polystyrene, acrylonitrile butadiene styrene, polyethylene terephthalate, polyester, polyamides, polyvinyl chloride, polyurethanes, and polycarbonate.

5. The connector assembly according to claim 1, wherein said first end of said electrical connector is a nut body.

6. The connector assembly according to claim 1, wherein said sleeve has a shape substantially corresponding to a shape of said first end.

7. The connector assembly according to claim 1, wherein said electrical connector is a co-axial connector.

8. The connector assembly according to claim 1, wherein the retaining member is a radial flange.

9. The connector assembly according to claim 1, wherein the sleeve engages the first end of the electrical connector by a friction fit.

10. A connector assembly, comprising of:

an electrical connector having opposite first and second ends, said first end being rotatable with respect to said second end and configured to couple to a mating connector, said second end being configured to terminate a cable; and a non-threaded sleeve including, an inner bore extending through said sleeve, said inner bore receiving said electrical connector, one portion of said inner bore being configured to ensnare said first end of said electrical connector, and another portion of said inner bore being configured to retain said electrical connector in said inner bore, and an outer gripping surface.

11. The connector assembly according to claim 10, wherein said sleeve has an elongated body having opposite ends.

12. The connector assembly according to claim 10, wherein said sleeve has a plurality of lateral surfaces disposed adjacent to each other and meeting at adjacent edges to form a substantially hexagonal shape in cross-section.

13. The connector assembly according to claim 12, wherein the sleeve has a first face and a second face at said opposite ends of said sleeve, the first and second faces being substantially perpendicular to said lateral surfaces.

14. The connector assembly according to claim 12, further comprising a spine disposed at said adjacent edges of said lateral surfaces, said spine extending longitudinally along said adjacent edges between said ends of said elongated body.

15. The connector assembly according to claim 10, wherein said sleeve is made of rubber.

16. The connector assembly according to claim 10, wherein said electrical connector is a co-axial connector.

17. The connector assembly according to claim 10, wherein said first end of said electrical body includes a nut body.

18. The connector assembly according to claim 10, wherein said inner bore of said sleeve has a retaining member that is a radial flange substantially preventing axial movement of said electrical connector in said inner bore.

19. A method of forming a connector assembly, comprising the steps of:

providing an electrical connector with first and second ends, the first end and the second end being adapted to be coupled to each other, the first end being rotatable with respect to the second end, the first end being configured to couple to a mating connector, and the second end configured to terminate a cable;

providing a non-threaded sleeve being configured to receive the electrical connector, the sleeve having an outer gripping surface, whereby the sleeve and the first end of the electrical connector together rotate with respect to the second end of the connector;

inserting the first end into one end of the sleeve;

inserting the second end into the opposite end of the sleeve; and assembling the first end and the second end within the sleeve such that the first end is in direct contact with the second end.

20. The method according to claim 19, further comprising the steps of:

terminating the cable at the second end of the electrical connector.

21. The method according to claim 19, further comprising the step of:

gripping the outer gripping surface of the sleeve to rotate the first end of the electrical connector.

22. The method according to claim 19, further comprising the steps of:

abutting the first end against a retaining member in an inner bore of the sleeve; and abutting the second end against the retaining member.

* * * * *

(12) INTER PARTES REVIEW CERTIFICATE (63rd)

United States Patent
Paglia et al.

(10) Number: US 7,544,094 K1
(45) Certificate Issued: Mar. 23, 2015

(54) CONNECTOR ASSEMBLY WITH GRIPPING SLEEVE

(75) Inventors: Richard Paglia; Weixing Chen; Minghua Gu

(73) Assignee: Amphenol Corporation

Trial Number:

IPR2013-00229 filed Apr. 2, 2013

Petitioner: PCT International, Inc.

Patent Owner: Amphenol Corporation

Inter Partes Review Certificate for:

Patent No.: 7,544,094
Issued: Jun. 9, 2009
Appl. No.: 12/003,109
Filed: Dec. 20, 2007

The results of IPR2013-00229 are reflected in this inter partes review certificate under 35 U.S.C. 318(b).

INTER PARTES REVIEW CERTIFICATE
U.S. Patent 7,544,094 K1
Trial No. IPR2013-00229
Certificate Issued Mar. 23, 2015

AS A RESULT OF THE INTER PARTES REVIEW PROCEEDING, IT HAS BEEN DETERMINED THAT:

Claims 1-13 and 16-18 are cancelled.

* * * * *